United States Patent [19]

Buecheler et al.

[11] Patent Number: 4,813,084

[45] Date of Patent: Mar. 21, 1989

[54] CLEANING SYSTEM FOR TOILET BOWLS

[75] Inventors: Herbert Buecheler, Erkrath; Thomas Capune; Bernd-Dieter Holdt, both of Duesseldorf; Ronald Menke, Mettmann; Erich Tuerk, Langenfeld, all of Fed. Rep. of Germany

[73] Assignee: Henkel Kommanditgesellschaft auf Aktien, Duesseldorf, Fed. Rep. of Germany

[21] Appl. No.: 123,084

[22] Filed: Nov. 20, 1987

[30] Foreign Application Priority Data

Nov. 20, 1986 [DE] Fed. Rep. of Germany ..... 3639686

[51] Int. Cl.[4] ..... E03D 9/02

[52] U.S. Cl. ..... 4/231; 422/266

[58] Field of Search ..... 4/231, 232, 223, 224–230, 4/222; 220/339, 335, 334, 242, 241, 363, 85 F, 229; 141/18, 21; 222/511; 422/261, 265, 266

[56] References Cited

U.S. PATENT DOCUMENTS

| | | | |
|---|---|---|---|
| 1,731,431 | 10/1929 | Meyer | 4/222.1 |
| 3,739,936 | 6/1973 | Jones, Jr. | 220/229 |
| 3,749,274 | 7/1973 | Mele et al. | 220/31 |
| 3,766,576 | 10/1973 | Ancel | 4/231 |
| 3,885,738 | 5/1975 | Chesmel et al. | 220/339 |
| 4,037,754 | 7/1977 | Wilhelmi et al. | 220/85 F |
| 4,053,084 | 10/1977 | Anderson | 220/229 |
| 4,095,365 | 6/1978 | Ray | 220/339 |
| 4,261,957 | 4/1981 | Schimanski | 422/263 |

FOREIGN PATENT DOCUMENTS

| | | | |
|---|---|---|---|
| 2820566 | 11/1979 | Fed. Rep. of Germany | 220/229 |
| 3419169 | 11/1985 | Fed. Rep. of Germany | 4/228 |
| 3424317 | 1/1986 | Fed. Rep. of Germany . | |

*Primary Examiner*—Henry J. Recla
*Assistant Examiner*—J. Casimer Jacyna
*Attorney, Agent, or Firm*—Ernest G. Szoke; Wayne C. Jaeschke; Real J. Grandmaison

[57] ABSTRACT

In a cleaning system for toilet bowls comprising a cleaning container for accommodating a cleaning preparation which is designed to be mounted on the rim of the toilet bowl and which is provided with correspondingly arranged openings for part of the flushing water to pass through, the invention enables the cleaning container to be filled with granular active substance without spillage and/or granulate to come into contact with the skin. In addition, the cleaning container is designed so that in the in-use position, its contents are substantially inaccessible to young children despite the refill facility. To this end, the cleaning container is provided with a closeable filling opening into which the mouth of a refill container adpated to the configuration of the filling opening is designed to be inserted in such a way that a pourable, more especially granular, cleaning preparation in the refill container can be poured into the cleaning container by opening the closure of the filling opening and keeping it open without any other manipulation of the closure of the cleaning container, after which the refill container may be withdrawn from the filling opening with automatic reclosing of the closure.

13 Claims, 4 Drawing Sheets

CLEANING SYSTEM FOR TOILET BOWLS

BACKGROUND OF THE INVENTION

1. Field of the Invention

This invention relates to a cleaning system for toilet bowls comprising a cleaning container for accommodating a cleaning preparation which is designed to be mounted on the rim of a toilet bowl and through which the water flows on flushing, the container being provided with an at least locally lattice-like or rib-like wall and with a clip for fastening to the rim of the bowl.

2. Discussion of Related Art

Basket-like containers accommodating a generally extruded sanitizing and/or perfuming block are used in so-called toilet hygiene. Toilet bowl blocks such as these may be placed against the side wall of the toilet bowl beneath its rim by means of a fastening clip corresponding in shape to the rim of the bowl. The toilet bowl block is activated, i.e. dissolved at its surface, by the stream of water which enters the toilet bowl on flushing either through emptying of the toilet tank or through operation of the flush valve. Accordingly, the active-substance solution is mixed with the water flowing through the container accommodating the block.

German patent application No. 34 24 317 describes a toilet cleaner designed for use in a container of the type described above, the toilet cleaner being introduced in particulate form into a cage-like container. For optimal release of active substance to the water flowing through the container and to facilitate the release of fragrance to the surrounding air, the toilet cleaner is preferably used in granulated form, i.e., with a very large surface area. The individual granulate particles are said to weigh between about 0.05 and 10 g and preferably between 0.1 and 0.2 g. These granulates have a diameter of from 2 to 8 mm. The granulates which are produced by extrusion have a circular or oval cross-section and are said to be cut to such lengths that the ratio of length to their diameter is between 1 and 2.

Variously designed toilet containers are commercially available for granular toilet cleaners. On the one hand, there are completely closed containers generally designed to be used once only. A particular feature of this type container is that it is child-proof. On the other hand, there are also open toilet containers which are designed primarily for refilling by the user. In use, however, the refill opening is covered by the rim of the toilet bowl which seriously hinders free access.

DESCRIPTION OF THE INVENTION

Other than in the operating examples, or where otherwise indicated, all numbers expressing quantities of ingredients or reaction conditions used herein are to be understood as modified in all instances by the term "about".

An object of the present invention is to provide a cleaning system wherein a toilet container may be cleanly refilled with granular active substance without spillage and without any need for the basket-like container and/or the granulate to come into contact with the skin. In addition, the new toilet container is designed in such a way that, in the in-use position, its contents are substantially inaccessible to young children despite its refill facility.

In the cleaning system of this invention, the aforementioned object is achieved by providing the cleaning container with a closeable filling opening into which the mouth of a refill container adapted to the configuration of the filling opening is designed to be inserted in such a way that a pourable, more especially granular, cleaning preparation in the refill container can be poured into the cleaning container by opening the closure of the filling opening and keeping it open without any other manipulation of the closure of the cleaning container, after which the refill container may be withdrawn from the filling opening with automatic reclosing of the closure.

The construction according to the invention provides for optimal cooperation between the cleaning container and the refill container, enabling the cleaning container to be cleanly refilled without spillage. The cleaning container may be refilled in its in-use position, i.e. in its suspended position in the toilet bowl, without contact, i.e. without skin contact with the cleaning container or the product. The fact that the closure of the filling opening is automatically reclosed ensures that, despite the refill facility, the contents of the cleaning container in the in-use position are substantially inaccessible to young children.

In one embodiment of the invention, the closure of the cleaning container comprises a flap which is designed to pivot inwards about a horizontal hinge axis in the opening direction against n elastic return force by pressing against the mouth of the refill container. This provides for safe, problem-free automatic reclosure of the filling opening because, after withdrawal of the mouth of the refill container, the closure recloses the filling opening under the elastic return force. This closure also prevents the entry of foreign bodies into the cleaning container and, hence, deleterious combination with chemically incompatible products, for example toilet cleaner, and at the same time makes access to the product difficult for children, as already described.

When the mouth of the refill container is introduced into and withdrawn from the filling opening of the cleaning container, a stripping effect is generated by the automatic cooperation of the cleaning container unimpeded by the closure flap. Another effect of this embodiment is that the refilling process may be completed without spillage, i.e. without any loss of cleaner product.

To ensure that the granular cleaning preparation normally present in the refill container flows out freely and to prevent blockage of the mouth of the refill container by the granular product, another embodiment of the invention is characterized in that the lower end of the filling opening and the inside of the mouth wall in the vicinity of the projection are rounded in coordination with one another with a radius which corresponds to between two and five times the radius of the granular cleaning preparation.

In another embodiment of the invention, refilling of the cleaning container is further facilitated by the fact that the surface of the cleaning container which faces towards the interior of the toilet bowl projects inwards beyond the rim of the toilet bowl and has surface regions arranged frustopyramidally to one another, the upper surface region forming the filling opening closeable by the closure flap.

Finally, in another embodiment of the invention, the lateral surfaces of the mouth of the refill container converge locally straight towards the rounded part of the mouth at an angle to one another which is adapted to the end of the filling opening of the cleaning container, while the edges of the mouth are formed with notches between the rounded part and the lateral boundary of the mouth. This embodiment further improves the co-operation of the flap closing the cleaning container with the mouth of the refill container in the form of the stripping effect described above.

The invention is described in more detail in the following with reference to the accompanying drawings.

DETAILED DESCRIPTION OF THE DRAWINGS

Figure 1:
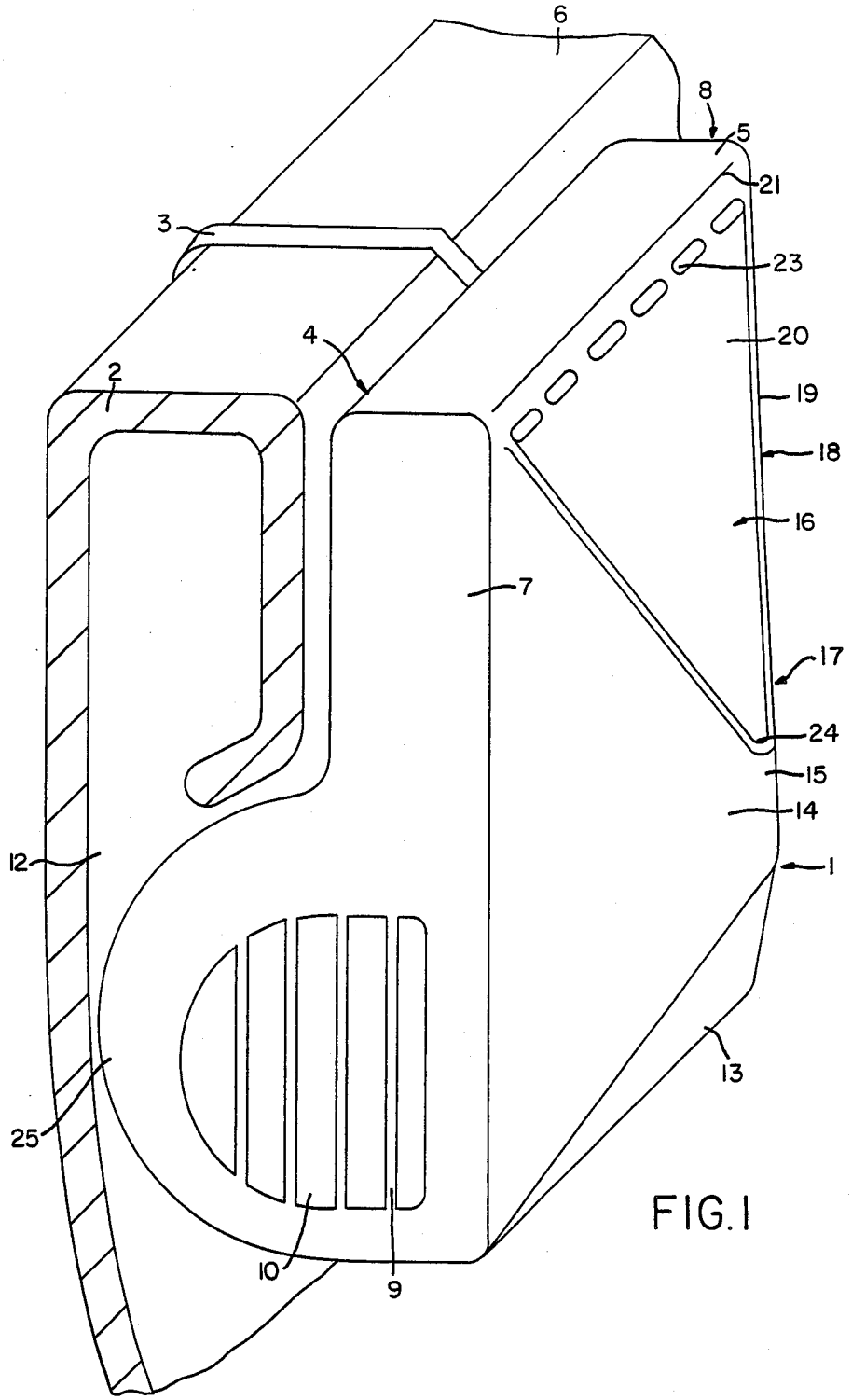
FIG. 1 is a perspective view of a cleaning container.

FIG. 1 is a perspective view of a cleaning container generally denoted by the reference 1 in its in-use and functional position on the rim 2 of a toilet bowl. The cleaning container 1 is suspended from the rim 2 of the toilet bowl by means of a clip 3. The clip 3 surrounds the rim 2 of the toilet bowl and is fastened to the back 4 of the cleaning container 1. The cleaning container 1 has a flat upper surface 5 which, in the in-use and functional position, is arranged substantially level with the flat upper surface 6 of the rim 2 of the toilet bowl. At the sides, the upper surface 5 is adjoined by lateral surfaces 7 and 8 which, at their lower ends, have a wall permeable to the flushing water. In the embodiment illustrated, the lateral surfaces are provided for this purpose with ribs 9 and wall perforations or openings 10. Since the cleaning container 1 is designed to function with granular active substance, the size of the inter-rib space or similar sieve width should correspond to approximately half the granulate diameter. These dimensions provide, on the one hand, for optimal fragrance emanation from, and flushing of, the product, and on the other hand no undissolved particles of product are flushed away by virtue of the tendency of the product particles to stick to one another during the flushing process. In addition, in this lower region, the back 4 of the cleaning container 1 is recessed to enlarge the interior 11 (see FIG. 2) of the container is such a way that it extends below the upper part of the rim of the toilet bowl in the rear part of the cleaning container 1 towards the inner wall 12 of the toilet bowl. That side of the cleaning container 1 which is directed towards the interior of the toilet bowl is formed by lateral surfaces 13, 14, 15, 16 and 17 converging frustopyramidally towards one another. A filling funnel generally denoted by the reference 18 is formed in this way, the upper surface 16 being designed to serve as a filling opening 19. The filling funnel 18 is preferably made integrally with the cleaning container 1. To produce this one-piece construction, the cleaning container 1 may first be molded in the form of two half-shells joined together by a film hinge and then closed into the final basket shape in use or during filling. In the in-use or functional position, the filling opening 19 is closed by a closure flap 20. The flap 20 is integrally joined with the upper surface 5 of the cleaning container 1 through a film hinge 21. In the closed position, the flap 20 is pressed elastically against the inner edge 22 (FIG. 2) of the surface 15 of the filling funnel which delimits the lower part of the filling opening 19. The elastic return force required for this purpose is provided by the film hinge 21. In addition, the film hinge 21 has perforations 23 for adjusting the desired return force and for producing a chimney-like effect to control the direction of flow of the fragrance emanating from the cleaner product.

The filling opening 19 of the filling funnel 18 is formed as a substantially triangular opening in the main lateral surface 16 facing towards the interior of the toilet bowl. At the edge between the upper surface 5 and the main lateral surface 16 facing the interior of the bowl, this triangular opening occupies the entire width of the main lateral surface 16 and tapers downwards to terminate in a rounded end 24 or the like. A substantially triangular filling opening 19 such as this may readily be serviced by a refill container having a matching opening. The cleaning container 1 as a whole is shaped in such a way that when clipped by the clip 3 in its in-use and functional position, it rests against the inside of the rim of the toilet bowl and can be refilled from above without contact through the filling opening 19 of the filling funnel 18. The cleaning container 1 is substantially parallelepipedic in shape with the narrow lateral surfaces 7 and 8 movement through a predetermined elastic return force of the closure in conjunction with the geometry of the mouth of the refill container and, inter alia, prevents spilling of the granulate. In this system, therefore, the closure of the filling opening performs the function of a stop valve which only allows product to flow through into the cleaning container in one direction and only when and as long as the mouth of the refill container is inserted therein.

So far as the production of the cleaning container according to the invention is concerned, another advantageous embodiment of the invention is characterized in that the closure flap is made integrally with the cleaning container from an elastic plastics material, a film hinge being provided between the flap and the cleaning container in another particularly practical embodiment of the invention.

According to another aspect of the invention, the return force of the flap is then advantageously predetermined by the spring characteristic of the film hinge.

In another embodiment of the invention, the film hinge also has perforations which control the direction of flow of a perfume and which may also be used to adjust the magnitude of the elastic return force.

In another embodiment of the invention, which provides for particularly favorable handling of the cleaning system, the filling opening and the closure flap of the cleaning container taper triangularly downwards from the upper horizontal hinge axis.

In another embodiment of the invention, which is designed to facilitate refilling of the cleaning container, an outwardly directed projection arranged on the mouth of the refill container is designed to be engaged in the lower end of the filling opening in such a way that, when the refill container is subsequently turned upwards about the lower end of the filling opening, regions of the mouth formed on both sides of the projection turn the closure flap of the filling opening inwards to such an extent that the cleaning preparation in the refill container drops into where the filling funnel 18 and a convex bulge 25 are respectively formed frustopyramidally towards the interior of the toilet and towards the inner wall of the toilet bowl.

Figure 2:
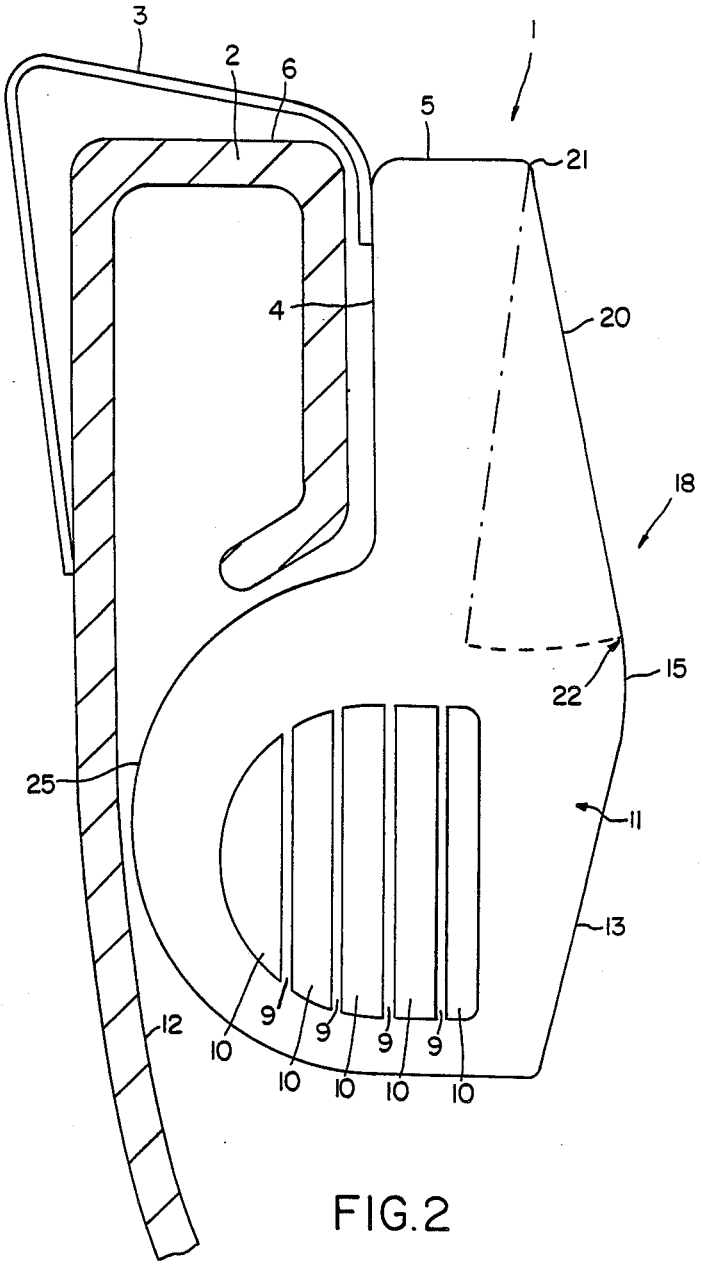
FIG. 2 is a vertical section taken perpendicularly to the filling opening of the cleaning container shown in FIG. 1.
Figure 3:
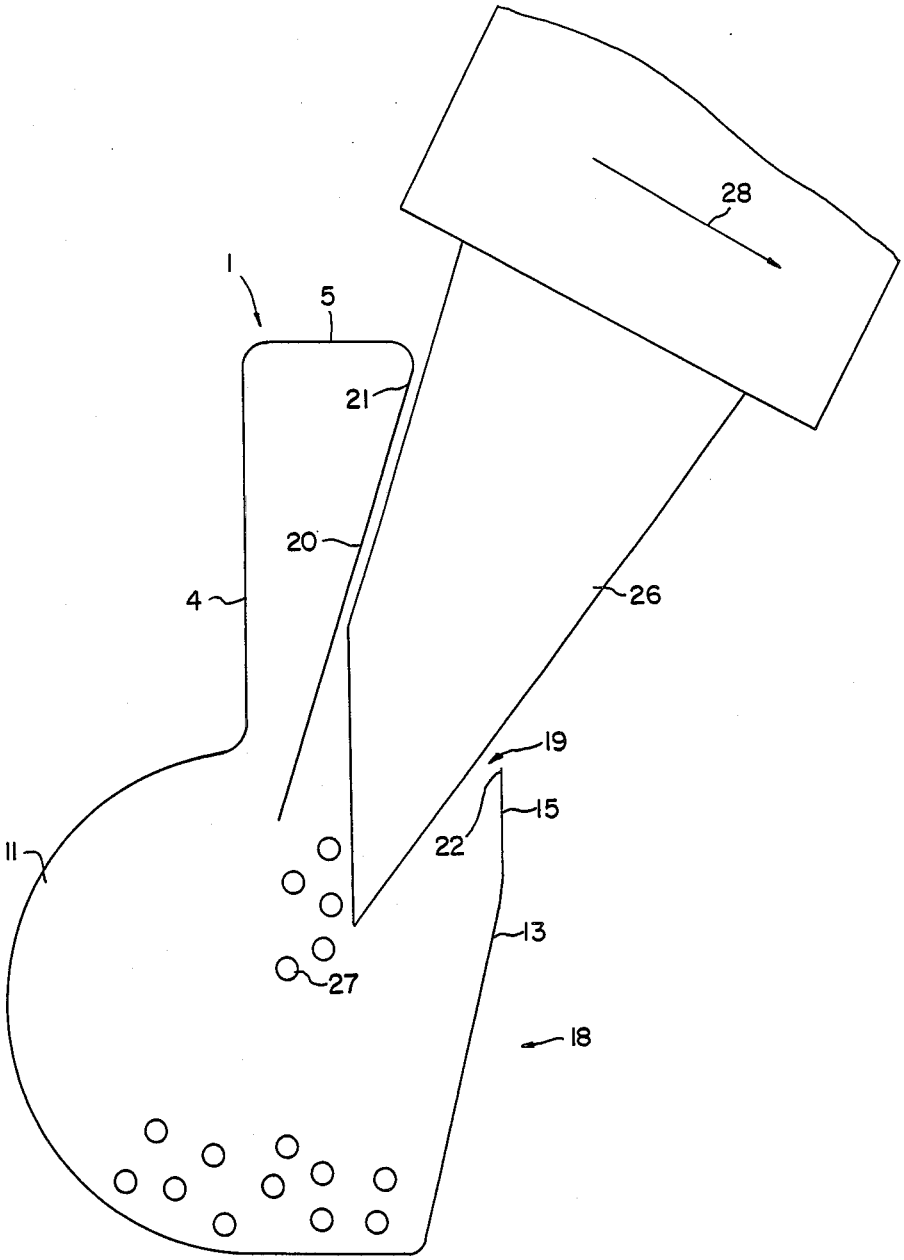
FIG. 3 is a section taken according to FIG. 2 with the mouth of a refill container inserted into the cleaning container.

The mode of operation of the filling opening 19 with the cover flap 20 is shown in FIGS. 2 and 3. Normally, i.e. when not refilling, the flap 20 is pressed against the inner rim 22 of the filling opening 19 by the return force of the film hinge 21. By contrast, during refilling, the mouth 26 of a refill container (FIG. 3) adapted to the filling opening 19 in such a way that the flap 20 is pressed inwards (shown in broken lines in FIG. 2) and, providing the refill container is suitable tilted, granular product 27 is able to drop into the cleaning container 1. When the refilling process is over and the mouth 26 is withdrawn from the filling opening 19, the flap 20 automatically follows the mouth 26 so that, when the container or rather the mouth 26 is tilted in the direction of the arrow 28 about a horizontal axis lying substantially in the front main surface 16 facing the interior of the toilet bowl and the mouth 26 is simultaneously withdrawn from the filling opening 19, any product continuing to flow down is stripped off by the flap 20.

Figure 6:
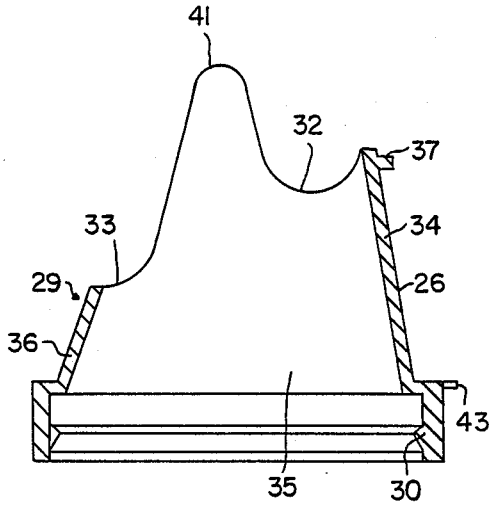
FIG. 6 is a vertical side section taken on the line I—I in FIG. 5.
Figure 4:
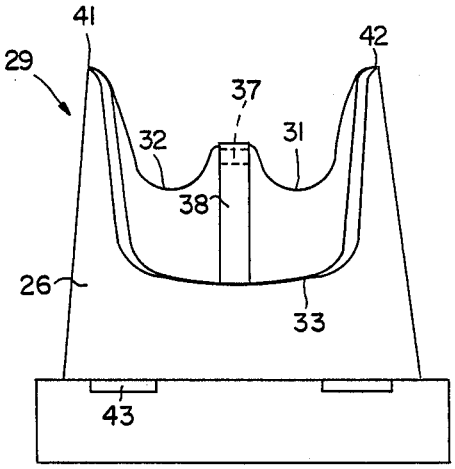
FIG. 4 is a backside elevation view of the mouth of a refill container.
Figure 5:
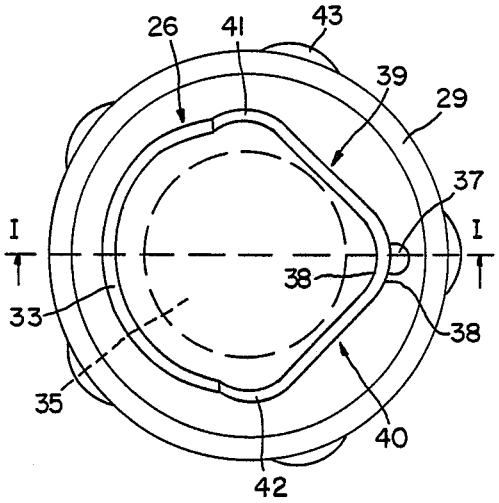
FIG. 5 is a plan view of the mouth shown in FIG. 4.

FIGS. 4 to 6 show an attachment generally denoted by the reference 29 for a refill container. The attachment 29 is provided with a screw thread 30 for screwing onto the refill container. The mouth 26 is formed in its wall with notches 31, 32 and 33 similarly to a hollow truncated cone, the wall 34 of the mouth which faces toward the filling funnel 18 during refilling being inclined towards the interior 35 of the mouth to a lesser extent than the opposite wall 36 of the mouth. An outwardly projecting nose or stud 37 is formed on the wall 34 of the mouth in the upper part thereof. The dimensions of the projection 37 are such that it can be engaged in the end of the filling opening 19, i.e., in the vicinity of the rounded end 24, and bears against the inner wall 22 of the surface 15 of the filling funnel when the mouth 26 is tilted towards the filling opening 19. In this region, the wall 34 of the mouth in particular is rounded at 38 in such a way that this part of the container wall 34 can be inserted in form-locking manner into the rounded end 24 of the filling opening 19. For this reason, the lateral surfaces 39 and 40 of the mouth 26 are made straight and converge on the rounded part 38 at an angle which corresponds to the angle formed at the rounded end 24 of the filling opening 19 by the edges of the lateral surfaces 14 and 17 which converge on the upper surface 5 of the cleaning container 1 from the rounded end 24. The walls of the lateral surfaces 39 and 40 thus converge on the sides 41 and 42 of the mouth 26 from the rounded part 38 at the angle described above. Starting from the level of the wall 34 in the vicinity of the projection 37, the wall 34 where it joins the sides 41 and 42 has notches 31 and 32, adjoining which the wall 34 of the mouth climbs to its highest regions 41 and 42. The rear part is adjoined semicircularly by the wall 36 of the mouth which, opposite the rounded part 38, has a notch 33 in the vicinity of which the upper edge of the mouth is distinctly lower than the upper edge of the wall 34 of the mouth in the vicinity of the notches 31, 32. Finally, the attachment 29 is formed with gripping aids 43.

In addition, both the rounded part 38 and the rounded end 24 have a radius which corresponds to between two and five times the average radius of the granulate to be poured into the cleaning container 1 through the mouth 26. The cleaning system described above is preferably designed for the granulate known from German patent application No. 34 24 317 which has a diameter between 2 and 8 mm.

The attachment 29 as a whole, by virtue of the highly contoured configuration of the mouth 26, serves as a container effectively adapted to the triangular filling opening 19 with the flap by which it is closed. When the cleaning container 1 is being refilled, the projection 37 is first engaged in the rounded end 24, the length of the projection 37 alone causing slight opening through inward pivoting of the flap 20. By further tilting of the mouth 26 towards the flap 20 about the point of application of the projection 37 and the rounded end 38, the flap 20 is pivoted inwards so that the filling opening 19 is sufficiently uncovered. During this movement, the regions 41 and 42 are pressed or applied to the surface of the flap 20. By virtue of the notches 31 and 32, an adequate flow of product from the mouth 26 into the cleaning container 1 is possible in this position. The notches 31 and 32 are preferably designed in such a way that the mouth 26 is opened to about one third of its overall length in the vicinity of the notches. The expression overall length in this context is intended to apply to the height of the walls 34 and 36 of the mouth as measured from the sides 41 and 42 to the beginning of the region in the form of a cylindrical disc comprising the screwthread 30.

When the above-described tilting movement of the mouth 26 is continued or the mouth 26 is inserted further into the cleaning container, the flap 20 is pressed to the wall 36 of the mouth in the rear part of the mouth 26. A stripping effect is produced by the elastic return force of the flap 20, even when the mouth 26 is withdrawn, so that any product 26 either drops back into the refill container or is moved into the cleaning container.

Accordingly, in combination with the flap 20, designed to open against an elastic return force in the manner of a stop valve, and the mouth 26 for the refill container adapted to the filling opening 19 and the flap 20, the refill opening 19 which points like a funnel into the interior of the toilet bowl enables the cleaning container 1 in its in-use position, i.e. the position in which it is suspended in the toilet bowl, to be refilled without contact, i.e. without skin or hand contact with the cleaning container or the product. The mouth 26 of the refill container to be engaged in or inserted into the filling opening 19 is the only necessary means of manipulation. In addition, providing the refill container is properly handled, hardly any product spills from the refill container into the toilet bowl. To this end, the mouth 26 of the refill container accommodating the granulate 27 to be introduced into the cleaning container is designed in such a way that it may be inserted like an adaptor into the filling opening of the cleaning container. After the mouth 26 has been fully withdrawn, the filling opening 19 is automatically reclosed by the closure of flap 20. As long as the mouth 26 is inserted in the filling opening 19, a sufficiently large pouring opening for the introduction of granulate 27 is present. The return force of the flap 20 is preferably predetermined by the spring characteristic of the film hinge 21. When the mouth of the refill container is introduced into and withdrawn from the filling opening of the cleaning container 1, a stripping effect is generated by the automatic cooperation of movement through the predetermined spring characteristic of the flap in conjunction with the geometry of the mouth of the refill container and, inter alia, prevents the spilling of the granulate. In this system, therefore, the flap of the filling opening performs the function of a stop valve which only allows product to flow through into the cleaning container in one direction and only when and as long as the mouth of the refill container is inserted.

All the surfaces of the cleaning container 1 are substantially flat surfaces which counteracts any danger of its soiling in the event of prolonged use in the toilet bowl and makes the surface easy to clean.

In particular, it is advisable to fill the cleaning system described above with spherical granulate. In the cleaning container 1, the flowthrough of water is retarded by the fissured or interstice-permeated product surface which is larger than that of a one-piece cleaning block. The desired effect in regard to lasting fragrance and a supply of flushing water enriched with active ingredients is thus distinctly improved. When the flushing system is actuated, the perfume-enriched product interstices are automatically emptied quasi-hydraulically. In addition, product components which would not be compatible with one another or storable with one another in a one-piece cleaning block may be stored together in the refill container and introduced together into the cleaning container. To this end, the individual spheres of the spherical granulate may be provided with a protective coating which dissolves rapidly on contact with water.

We claim

1. A cleaning system for a toilet bowl comprising a cleaning container for accommodating a cleaning preparation which is designed to be mounted on the rim of said toilet bowl and which is provided with corresponding arranged openings for part of the flushing water to pass through said container, said cleaning container having a closeable filling opening into which the mouth of a refill container adapted to the configuration of said filling opening is designed to be inserted so that a pourable, granular cleaning preparation contained in said refill container can be poured into said cleaning container by opening the closure of the filling opening and keeping it open without any other manipulation of the closure of the cleaning container, after which the refill container may be withdrawn from the filling opening with automatic reclosing of the closure, said closure comprising a flap designed to pivot about a horizontal axis thereon in the opening direction of said closure against an elastic return force by pressing against the mouth of said refill container, said flap being made integrally with said cleaning container from an elastic plastics material, said cleaning container including a film hinge formed between said flap and the upper surface of said cleaning container wherein the return force of said flap is predetermined by the spring characteristic of said film

2. A cleaning system as in claim 1 wherein said filling opening and said closure flap of said cleaning container taper triangularly downwards from the upper horizontal hinge axis of said film hinge.

3. A cleaning system as in claim 2, wherein an outwardly directed projection is provided on the mouth of said refill container and is designed to be engaged in the lower end of said filling opening in such a way that when said refill container is subsequently turned upwards about said lwoer end of said filling opening, regions of the mouth of said refill container formed on both sides of said projection press said closure flap of said filling opening inwards to such an extent that the cleaning preparation in said refill container drops into said cleaning container unimpeded by said closure flap.

4. A cleaning system as in claim 3, wherein the lower end of said filling opening and the inside of the mouth wall in the vicinity of said projection are rounded in coordination with one another with a radius which corresponds to between two and five times the radius of the granular cleaning preparation.

5. A cleaning system as in claim 4 wherein the lateral surfaces of the mouth of said refill container converge locally straight towards a rounded part of the mouth at an angle to one another which is adapted to the lower end of said filling opening of said cleaning container, and the edges of the mouth are formed with notches between the rounded part and the lateral boundaries of the mouth.

6. A cleaning system as in claim 1 wherein the surface of the cleaning container which faces towards the interior of the toilet bowl projects inwards beyond the rim of the toilet bowl and has surface regions arranged frustopyramidally to one another, the upper surface region forming the filling opening closeable by the flap.

7. A cleaning system as in claim 1 wherein said cleaning container has a clip attached to the back side thereof for mounting said cleaning container on the rim of a toilet bowl.

8. The combination of a cleaning container and a refill container, said cleaning container accommodating a cleaning preparation and being designed to be mounted on the rim of a toilet bowl, said cleaning container being provided with openings in the lower portion thereof for passage therethrough of flushing water, a closeable filling opening into which the mouth of a refill container adapted to the configuration of said filling opening is designed to be inserted therein so that a pourable, granular cleaning preparation contained in said refill container can be poured into said cleaning container by opening the closure of said filing opening and keeping it open, and whereby said refill container may be withdrawn from said filling opening with automatic reclosing of the closure, said closure comprising a flap designed to pivot about a horizontal axis thereon in the opening direction of said closure against an elastic return force by pressing against the mouth of said refill container, said flap being made integrally with said cleaning container from an elastic plastics material, said cleaning container including a film hinge formed between said flap and the upper surface of said cleaning container wherein the return force of said flap is predetermined by the spring characteristic of said film hinge, said film hinge being formed with perforations therein for adjusting the magnitude of the elastic return force of said flap and controlling the direction of flow of a perfume.

9. The combination as in claim 8 wherein said cleaning container has a clip attached to the back side thereof for mounting said cleaning g container on the rim of a toilet bowl.

10. The combination as in claim 8 wherein said filling opening and said closure are tapered, becoming triangularly narrower from the area of said film hinge.

11. The combination as in claim 8 wherein an outwardly directed projection provided on the mouth of said refill container is designed to be engaged in the lower end of said filling opening in such a way that when said refill container is subsequently turned upwards about said lower end of said filling opening, regions of the mouth of said refill container formed on both sides of said projection press said closure flap of said filling opening inwards to such an extent that the cleaning preparation in said refill container drops into said cleaning container unimpeded by said closure flap.

12. The combination as in claim 11 wherein the lower end of said filling opening and the inside of the mouth wall in the vicinity of said projection are rounded in coordination with one another with a radius which corresponds to between two and five times the radius of the granular cleaning preparation.

13. The combination as in claim 8 wherein the surface of the cleaning container which faces towards the interior surface of the toilet bowl projects beyond the rim of the toilet bowl and has regions arranged frustopyramidally to one another, the upper surface region forming the filling opening closeable by the flap.

* * * * *

UNITED STATES PATENT AND TRADEMARK OFFICE

CERTIFICATE OF CORRECTION

PATENT NO. : 4,813,084

DATED : March 21, 1989

INVENTOR(S) : Herbert Buecheler, Thomas Capune, Bernd-Dieter Holdt, Ronald Menke, Erich Tuerk It is certified that error appears in the above-identified patent and that said Letters Patent is hereby corrected as shown below:

At Col. 6, line 33, "product 26" should read --product 27--.

At Col. 7, line 53, in claim 1, after "film" should read --hinge, said film hinge being formed with perforations therein for adjusting the magnitude of the elastic return force of said flap and controlling the direction of flow of a perfume.--.

At Col. 7, line 63, in claim 3, "lwoer" should read --lower--.

At Col. 8, line 36, in claim 8, "filing" should read --filling--.

At Col. 8, line 55, in claim 9, after "cleaning", delete --g--.

Signed and Sealed this

Twentieth Day of June, 1989

*Attest:*

DONALD J. QUIGG

*Attesting Officer*

*Commissioner of Patents and Trademarks*